United States Patent [19]

Roberts

[11] Patent Number: 4,575,786

[45] Date of Patent: Mar. 11, 1986

[54] RADIATION EMITTING APPARATUS

[75] Inventor: John C. Roberts, Bristol, England

[73] Assignee: British Aerospace Public Limited Company, London, England

[21] Appl. No.: 484,361

[22] Filed: Apr. 12, 1983

[30] Foreign Application Priority Data

Apr. 13, 1982 [GB] United Kingdom ..... 8210362

[51] Int. Cl.[4] ..... F21V 7/00

[52] U.S. Cl. ..... 362/279; 362/281; 362/283; 362/291; 362/305; 362/308; 362/340; 362/346; 340/815.17

[58] Field of Search ..... 362/19, 35, 279, 281, 362/283, 291, 305, 308, 340, 346; 340/815.17

[56] References Cited

U.S. PATENT DOCUMENTS 3,221,162 11/1965 Heenan ..... 362/280

4,173,777 11/1979 Schmit ..... 362/253

*Primary Examiner*—Donald P. Walsh

*Attorney, Agent, or Firm*—Cushman, Darby & Cushman

[57] ABSTRACT

A modulated optical radiation beacon, e.g. a flashing light beacon or an IR emmissive missile jamming source, can comprise a radiation source and two relatively movable apertured masks which, as the apertures thereof move into and out of registration, pass or block the radiation from the source. Herein, to improve the uniformity of the polar distribution of the emitted radiation (assuming, of course, that a uniform distribution is required) or, in other cases, simply to improve efficiency, the apertures of the 'inner' mask, i.e. the one nearest the source, are bounded by curved reflective surfaces defining an optical cavity which at least crudely images the source at a position near the outer mask. Advantageously, the optical cavities are defined by a spaced array of prismatic members having appropriately curved facing surfaces.

14 Claims, 3 Drawing Figures

RADIATION EMITTING APPARATUS

Figure 1:
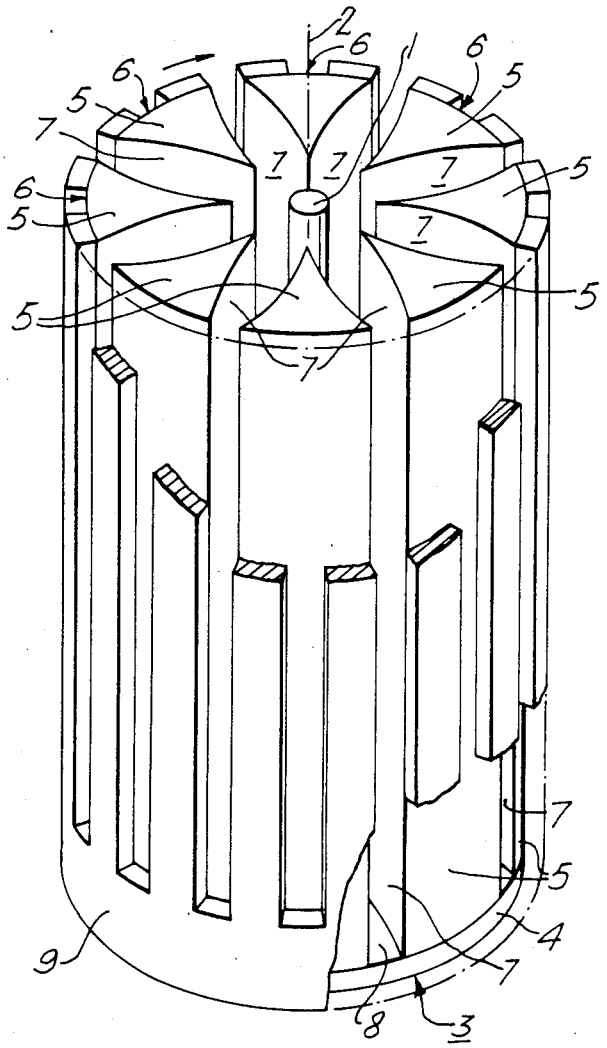

This invention relates to modulated optical radiation emitting apparatus, for example a flashing light beacon.

A flashing light beacon may comprise a light source and a rotatable mask member surrounding the light source. The mask member has a series of apertures in it arrayed around the source and, as it rotates, the light emitted from the source in any one direction is modulated. However, because some of the light will be reflected from the inner surface of the mask member for example, light spreads out from each aperture and it is not possible to obtain a 100% modulation depth. This depth could be improved by the provision of a fixed inner mask member also having apertures, the radiated light then being modulated by the movement into and out of alignment of the respective apertures. Now, however, the polar distribution diagram of the radiated light will be non-circular, i.e. in some directions less light will be radiated than in others. This lost light may be being absorbed by the inner mask and hence wasted.

The object of this invention is to reduce the wasted radiation. For example, if required, to provide a relatively closely circular polar distribution from a modulated optical radiation emitting apparatus having the general nature of the flashing light beacon described above. Alternatively, it may be that a circular distribution is not required, i.e. it may be wished to direct more of the modulated radiation in one direction than another. In this case, the invention is still applicable and has the object, as mentioned, of reducing wasted radiation.

According to one aspect of the invention, there is provided a modulated optical radiation beacon comprising a radiation source and first and second relatively movable, apertured mask members positioned so that the first is nearer the source than the second and operable for being moved relative to one another to modulate the radiation from said source, said first member having at least one aperture bounded by a reflective curved surface and operable to reflect radiation from said source to form at least a crude image of said source at or near the outer member.

According to another aspect of the invention, there is provided a modulatable optical radiation beacon comprising a radiation source and inner and outer relatively movable, apertured mask members surrounding the source and operable for being relatively moved to modulate the radiation from the source, the inner mask comprising apertures of which the openings nearer the source are such as to receive, together, substantially all of the radiation from the source, and which have curved reflective side walls to reflect at least substantially all of the radiation incident thereon out of the outer openings of the apertures.

The aperture(s) in the first or inner mask member can have reflective end surfaces to give multiple reflections and an increased apparent size of the source.

The first or inner mask member can comprise a core assembly made up of a plurality of prismatic members having curved surfaces and defining between them said aperture(s).

Figure 2:
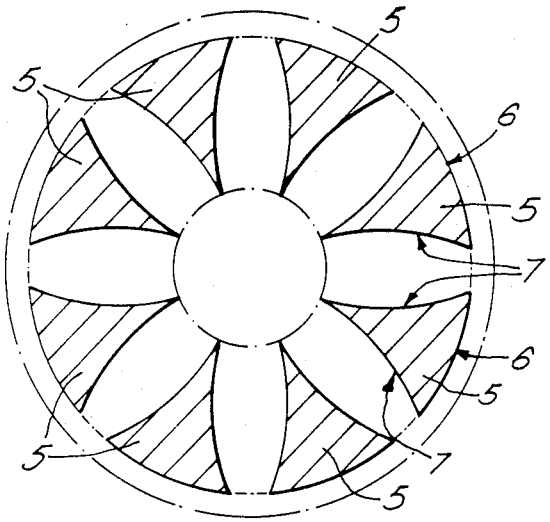
Figure 3:
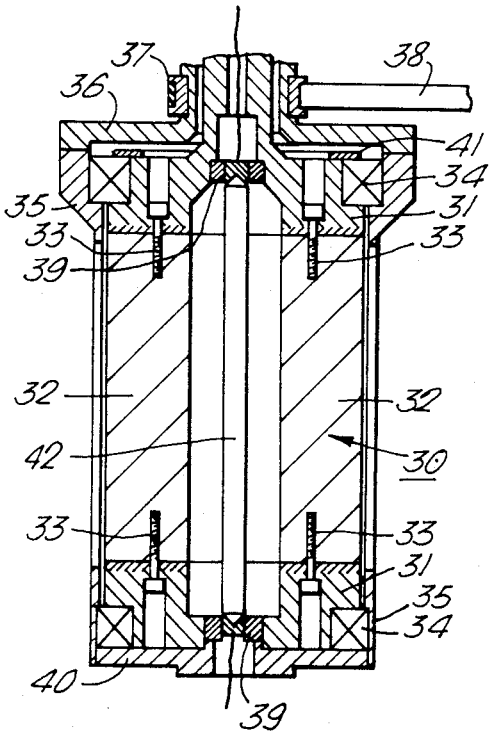

For a better understanding of the invention, reference will now be made, by way of example, to the accompanying drawings, in which FIG. 1 is a perspective view of part of a modulatable optical radiation beacon, FIG. 2 is a cross-sectional view of a core assembly used in the FIG. 1 beacon, and FIG. 3 is a sectional elevation of a carrier wave jammer.

The light beacon shown comprises a central elongate optical radiation source 1 such as a fluorescent tube, contained within and aligned with the axis 2 of a generally cylindrical radiation directing core assembly 3. The assembly 3 comprises two circular end plates 4 (only one of which can be seen on FIG. 1) and, extending between the end plates, a circular array of spaced elongate prismatic members 5 each extending parallel to axis 2. Each member 5 is generally triangular but with curved surfaces, one convex surface 6 and two concave surfaces 7. The convex surface 6 faces outwards and conforms to the cylindrical shape of the assembly. The apex between the two concave surfaces 7 points inwards to the source 1. Each concave surface 7 and those portions 8 of the inwardly facing surfaces of end plates 4 which lie between the members 5 are polished to become optically reflective. The concave surfaces 7 are quasielliptical in form and each defines, with the opposing surface 7 of the next adjacent member, an optical cavity which performs the function of an optical condenser. Thus, the curved surfaces of each cavity reflect the radiation received thereby from the source 1 into a discrete zone at or near the periphery of the assembly, i.e. at or near where the cavity opens to the exterior of the assembly. In effect, there is formed a more or less crude image of the source at the opening of each cavity. Thus, radiation emitted from each opening augments that from the adjacent cavities and, by carefully selecting the curvature of the cavity walls, there can be obtained an output polar distribution which approaches a true circle much more closely than would otherwise be the case.

The reflective surfaces presented at the end of each cavity, i.e. the reflective inwardly facing surface portions 8 of each end plate 4 produce multiple reflections between one another with the effect that the apparent length of each peripheral source image becomes, at least theoretically, infinite. This controls the intensity distribution along the axis 2.

In order to modulate the beacon to make the radiation therefrom flash on and off a rotatable slotted cylinder 9 is engaged around the core assembly and driven to rotate by say an electrical motor (not shown).

As will be appreciated, it may be desirable to achieve some non-symmetrical polar distribution of the optical radiation and this symmetry can be modified in the illustrated beacon by displacing the central source relative to the core assembly 3 or by displacing the members 5 relative to one another. Also instead of a single source, a desired distribution may be obtainable by the use of two or more sources at suitable positions within the core assembly.

As well as or instead of rotating the cylinder 9 the core assembly 3 can be rotated. If both are rotated, then control of the relative speed and/or direction of rotation can be selected to give a variety of modulation effects.

One application of the described beacon is as a countermeasure to some types of infra-red seeking missile. Thus, as shown in the sectional elevation of FIG. 3, a carrier-wave jammer may comprise a core assembly 30 made up of two aluminium end plates 31 with a spaced circular array of aluminium prismatic members 32 extending between the plates and fixed thereto by screws 33. The members 32 are shaped to form optical cavities as in FIGS. 1 and 2 and their concave surfaces, along with the exposed inwardly-facing surface portions of the end plates 31, are diamond cut to a highly reflective finish. Each plate 31 has a peripheral shoulder forming a seat for a respective bearing 34. The bearings support a slotted chopper drum 35 which is closed at one end by a spigoted plate 36, the spigot carrying a pulley wheel 37 to which, via belt 38, rotation may be imparted from an electrical motor (not shown). The spigot has a central aperture through which emerges a shaft-like extension of the end plate 31 at this end of the jammer. This shaft may be fixed to a mounting on an aircraft (not shown) or used to impart rotational movement to the core assembly. A rod-shaped infra-red source 42 is supported at its ends by electrical contact and support assemblies 39 (shown only diagrammatically) held in suitable seatings in the end plates 31. One of the bearings 34 is held in place by a cover plate 40 fixed to the end plate 31 which is remote from the pulley wheel 37 while the other bearing is held by an annular member 41.

The prismatic members 32 may be hollow or have bores formed therein to decrease weight and/or to receive cooling fluid.

I claim:

1. An optical radiation beacon comprising:

a radiation source, first and second apertured mask members positioned so that the first is nearer said source than the second and mounted for movement relative to one another, and drive means for relatively moving the mask members to bring the apertures therein repetitively into and out of alignment, each aperture in said first member being bounded at two opposite sides of the aperture by respective curved reflective surfaces which gather radiation received from the source and form at least a crude image of the source at or near said second member.

2. A beacon according to claim 1 wherein the apertures in said first mask member have reflective end surfaces operable to produce multiple reflections therebetween and increase the apparent size of the source.

3. A beacon according to claim 1, wherein the first mask member comprises a core assembly made up of a plurality of prismatic members having curved surfaces and defining between them said apertures.

4. A modulatable optical radiation beacon comprising a radiation source and inner and outer relatively movable, apertured mask members surrounding the source and operable for being relatively moved to modulate the radiation from the source, the inner mask comprising apertures of which the openings nearer the source are such as to receive, together, substantially all of the radiation from the source, and which have curved reflective side walls to reflect at least substantially all the radiation incident thereon out of the outer openings of the apertures.

5. A device for generating a modulated optical radiation signal, the device comprising:

support means;

an optical radiation source supported by the support means;

optical cavity defining means extending around said source and comprising portions which define a generally cylindrical outer surface of the optical cavity defining means and, spaced around the radiation source, a plurality of optical cavities which have curved reflective side walls and which are operable to gather radiation received from the source and to permit said radiation to pass to the outside of the optical cavity defining means; and a cylinder which extends around the optical cavity defining means and is supported by said support means for rotation with respect to the optical cavity defining means, the cylinder having a plurality of apertures therein which, during said rotation, come into and out of alignment with said cavities to modulate the radiation passed from said source to the exterior of the device.

6. A device according to claim 5, wherein the end walls of said cavities are reflective.

7. A device according to claim 5, wherein said source is an infra-red radiation source.

8. A device according to claim 5, wherein said cylinder and said optical cavity defining means are each supported by the support means for rotation with respect to the support means about a common axis.

9. A device according to claim 5, including motor drive means coupled to said cylinder for rotating it.

10. A device for generating a modulated infra-red radiation signal comprising:

an elongate infra-red radiation source;

an optical cavity defining assembly including a plurality of elongate prismatic members each having a cross-sectional shape which is generally triangular except that two of its sides are concavely curved, the members being spaced around said source with, in each case, that apex of said triangular cross-sectional shape which is between said two concavely curved sides being directed inwardly towards said source, said two curved sides each being reflective to said infra-red radiation;

a chopper drum which extends around said optical cavity defining assembly and which has a plurality of elongate apertures therein, the chopper drum being rotatable with respect to said cavity defining assembly for said apertures to be brought into and out of alignment with the spaces between said elongate prismatic members and thereby respectively to permit and not to permit radiation to pass from said source to the exterior of the device; and drive motor means coupled to said chopper drum for rotating it with respect to the cavity defining assembly.

11. A device according to claim 10, wherein said elongate prismatic members are fixed to and extend between two generally circular end plates which also support said infra-red radiation source and, by way of respective bearings, the two ends of said chopper drum.

12. A device according to claim 11, wherein the inwardly facing surface portions of the end plates which lie between said prismatic members are reflective to said radiation.

13. A device according to claim 11, wherein said prismatic members have hollow spaces therein.

14. A device according to claim 11, wherein said prismatic members are made of aluminum and said curved surfaces thereof have been rendered reflective by a diamond finish cutting process.

* * * * *